US006559741B2

(12) United States Patent
Takeda

(10) Patent No.: US 6,559,741 B2
(45) Date of Patent: May 6, 2003

(54) DISTRIBUTED ELEMENT FILTER

(75) Inventor: Shigeki Takeda, Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/845,058

(22) Filed: Apr. 26, 2001

(65) Prior Publication Data

US 2001/0054943 A1 Dec. 27, 2001

(30) Foreign Application Priority Data

Apr. 27, 2000 (JP) ..... 2000-128169
Aug. 28, 2000 (JP) ..... 2000-258018

(51) Int. Cl.[7] ..... H01P 1/203
(52) U.S. Cl. ..... 333/204; 333/219
(58) Field of Search ..... 333/203–205, 333/219, 185

(56) References Cited

U.S. PATENT DOCUMENTS 3,745,489 A * 7/1973 Cristal et al. ..... 333/204
4,992,759 A * 2/1991 Giraudeau et al. ..... 333/204
5,187,459 A * 2/1993 Russell et al. ..... 333/204
5,648,747 A * 7/1997 Grothe et al. ..... 333/204
5,880,656 A * 3/1999 Yabuki et al. ..... 333/204
6,300,849 B1 * 10/2001 Takeda ..... 333/202

FOREIGN PATENT DOCUMENTS

DE 195 09 251 3/1995
JP 02206201 A * 8/1990
JP 2001-060803 3/2001

OTHER PUBLICATIONS

Fechner, Harald; "Cauerparameter–Bandpasse in Mikrostreifenleiter–Technik". In Frequenz 34(1980), pp. 78–89.
* cited by examiner

*Primary Examiner*—Seungsook Ham
(74) *Attorney, Agent, or Firm*—Hogan & Hartson, LLP

(57) ABSTRACT

A band pass distributed element filter having real and imaginary transmission zeros by sequentially connecting half wavelength microstrip resonators and adding a cross coupling circuit has been difficult to implement as a planar circuit on the same plane, since the cross coupling circuit crosses one of the resonators. The distributed element filter is constructed by sequentially connecting n half wavelength microstrip resonators (n is an even number equal to or more than 4) each formed from a straight or hairpin microstrip line, wherein the number of straight microstrip lines and the number of hairpin microstrip lines are both odd, and wherein quarter wavelength straight microstrip lines for external circuit connection are coupled to the first and n th resonators, respectively, and a cross coupling circuit is connected to the microstrip lines of these resonators or to the ends coupled to the microstrip lines. A band pass filter can thus be realized using only a planar circuit by preventing the cross coupling circuit from crossing any one of the resonators.

10 Claims, 15 Drawing Sheets

COMPARATIVE EXAMPLE

COMPARATIVE EXAMPLE

COMPARATIVE EXAMPLE

COMPARATIVE EXAMPLE

DISTRIBUTED ELEMENT FILTER

BACKGROUND OF THE INVENTION

1. Field of the Invention

The present invention relates to a distributed element filter used in the RF (radio frequency) stage, etc. for mobile communication equipment as a bandpass filter to suppress noise and interfering signals, and more particularly to a distributed element filter which has flat amplitude characteristics and a flat group delay time in the passband, and transmission zeros in the stopbands, and is simplified in configuration so as to reduce losses for the improvement in performance so as to be advantageously used as a band pass filter.

2. Description of the Related Art

In high frequency circuit sections such as the RF stage of transmitter and receiver circuits for mobile communication system represented by analog or digital portable telephones or wireless telephones are often used bandpass filters (BPFs), for example, to attenuate harmonics radiation which are caused by the nonlinearity in amplifier circuits, or to eliminate undesired signal waves such as interfering waves, sidebands, etc. from the desired signal waves, or when using a common antenna for both the transmitter and the receiver circuits, to separate out the transmitter frequency band and the receiver frequency band that is different from the transmitter frequency band.

Generally, an ideal filter should have characteristics to pass desired signals without producing any distortion and to sufficiently attenuate interfering signals outside the passband. As shown in the diagrams of FIGS. 16A and 16B depicting the filter amplitude and the group delay time, the ideal filter characteristics must have a flat amplitude 17 as well as a flat group delay 18 throughout the passband, while at the same time, realizing attenuation poles 19, 20, i.e., transmission zeros, in the stopbands. In the prior art, complex circuit design has been required for the realization of such a filter.

Techniques for directly realizing a bandpass filter having such characteristics, based on a clear design procedure, are not known in the prior art, and it is common practice to construct filters empirically by mixture of various known techniques.

On the other hand, band pass filters for such communication applications are generally realized and constructed as filter circuits having the desired passband/stopband characteristics by connecting series or parallel resonant circuits constructed with various circuit elements in a plurality of stages. In many cases, filter circuit blocks are constructed by unbalanced distributed constant transmission lines such as coupled microstrip lines or patch resonators, because they have good electrical characteristics for high frequency circuits, and are small in size as circuit elements, and so on.

In fact, using coupled microstrip lines, band pass filters with characteristics having no attenuation poles can be easily realized. Conventional filters composed of a plurality of coupled resonators by quarter wavelength $\lambda/4$ ($\lambda$ is the wavelength) coupled microstrip lines have uniformized coupling structure and generally allow little freedom in design, for example the sign, positive or negative, of each coupling reactance element cannot be chosen freely as described hereinafter. Consider the prior art example shown in FIGS. 17A and 17B. A ladder network with parallel and series resonators in FIG. 17A is transformed using imaginary gyrators to a circuit in FIG. 18 which is compose of only parallel resonators that are easy to realize. FIG. 17A is an original circuit an example of a third order filter, and FIG. 17B is its strictly equivalent circuit that is derived using imaginary gyrators 21, 22.

In this case, for a strict transformation from the filter of FIG. 17A to the equivalent filter of FIG. 17B, the two imaginary gyrators 21, 22 must be made opposite in sign. That is, strictly, the coupling reactance elements must have both signs, positive and negative. In practice, it is difficult to realize a coupling structure by $\lambda/4$ coupled microstrip lines to achieve this.

On the other hand, in the case of a filter with simple characteristics having no attenuation poles, since no cross coupling is required in the filter circuit, there is no need to strictly control the positive and negative signs of the coupling; consequently, the imaginary gyrators may have only the positive or the negative sign, or the positive and the negative signs may be interchanged. As a result, the filter circuit can be realized without any problem, even with a structure in which a plurality of resonators formed by $\lambda/4$ coupled microstrip lines are sequentially coupled in the same manner.

By contrast, in the case of a filter with complex characteristics that have attenuation poles or that need controlling the group delay and amplitude characteristics, a cross coupling structure is needed in the filter circuits, and the positive and negative phases of the coupling characteristics must be controlled strictly. As a result, $\lambda/4$ coupled microstrip lines cannot arbitrarily give the positive and negative phases of the coupling characteristics, and it is difficult to use them as circuit elements for a filter circuit, and hence, it is difficult to create desired attenuation poles or to get prescribed amplitude and group delay characteristics by filter elements by $\lambda/4$ coupled microstrip lines.

Multi-resonator filters constructed by connecting such $\lambda/4$ coupled microstrip lines in multiple stages usually use straight microstrip lines; on the other hand, so-called hairpin-type multi-resonator filters constructed with microstrip resonators formed from bent microstrip lines called hairpin transmission lines are also used. Examples are shown in FIGS. 18A and 18B; FIG. 18A is a plan view showing an example of a multi-resonator filter of straight line type constructed by sequentially coupling four microstrip resonators 1 to 4 formed from straight microstrip lines, and FIG. 18B is a plan view showing an example of a multi-resonator filter of hairpin type constructed by sequentially coupling four microstrip resonators 5 to 8 formed from hairpin microstrip lines.

The hairpin-type multi-resonator filter, however, has the same problem as described above.

To solve the above problem, the inventor has previously proposed distributed element filters constructed with microstrip resonators in multiple stages formed by sequentially cascading quarter wavelength of the center frequency of the passband coupled microstrip lines. In these distributed element filters, a resonator sequentially coupling method that allows to align accurately the phase of the transmission characteristics is employed assuming by adding a cross coupling circuits to the sequentially coupled resonators it becomes possible to form attenuation poles and control the amplitude characteristic as well as group delay time.

However, the problem to he solved with these distributed element filters is how the cross coupling circuit is connected to the sequentially coupled microstrip resonators formed on the same plane. More specifically, when forming a cross coupling circuit for realizing the desired characteristics, and when the number of resonators to be cross coupled is an even number equal to or more than 4; as a result, if the cross coupling is to be made among the quarter wavelength coupled microstrip lines or quarter wavelength coupled hairpin microstrip lines formed on the same plane, as shown, for example, in the plan views of FIGS. 19A to 19D depicting a filter configuration example, the cross coupling circuit 11, 14 inconveniently has to cross the resonator pattern indicated at 1 to 10, 12, 13. It is therefore required that the cross coupling circuit be formed in a three dimensional structure; that is, in an air bridge structure, for example, through the space over the resonator pattern. This, in turn, leads to the drawback that the advantage that this distributed element filter is a planar circuit is lost.

In the filters shown in FIGS. 19A and 19B, of the four coupled straight microstrip resonators the first and fourth resonators 1, 4 are connected to the cross coupling circuit 11 directly (FIG. 19B) or via external circuit connection lines 9, 10 (FIG. 19A) coupled to the respective resonators. Likewise, in the filters shown in FIGS. 19C and 19D, of the four coupled hairpin microstrip resonators the first and fourth resonators 5, 8 are connected to the cross coupling circuit 14 directly (FIG. 19D) or via external circuit connection lines 12, 13 (FIG. 19C) coupled to the respective resonators. In any of these examples, the cross coupling circuit 11, 14 crosses one of the first to fourth resonators 1 to 4; 5 to 8, leading to the problem that the cross coupling circuit needs to be formed in a three dimensional structure in order to prevent the formation of an electrical connection at this crossing point.

In this way, when connecting a cross coupling circuit 11, 14 to a distributed element filter constructed with an even number (equal to or more than 4) of sequentially coupled and connected microstrip resonators formed on the same plane, the cross coupling circuit must be formed in a three dimensional structure to prevent it from shunted to any one of the resonators 1 to 4; 5 to 8. It is therefore desired to achieve cross coupling of the design value in a distributed element filter by using only a two dimensional structure. This would enable attenuation poles to be formed and the amplitude characteristic and group delay time to be adjusted within a filter of a simple planar structure, offering an enormous practical advantage that a band pass filter that has band pass characteristics achieving both a flat amplitude and a flat group delay over the passband, while at the same time, realizing transmission zeros in the stopbands, could be constructed and realized with simple circuitry supported by an accurate design technique. It is thus desired to realize the connection of a cross coupling circuit on the same plane without employing a three dimensional structure, and thereby provide a distributed element filter that can be realized and fabricated easily without impairing the advantage of the distributed element filter of the planar structure.

SUMMARY OF THE INVENTION

The invention has been devised to solve the above-outlined problem, and its object is to provide a distributed element filter that has band pass characteristics achieving both a flat amplitude and a flat group delay over the passband, while at the same time, realizing transmission zeros in the stopbands, by realizing the connection of a cross coupling circuit on the same plane without employing a three dimensional structure and without impairing the advantage of the distributed element filter of the planar structure, and that has low sensitivity and low loss characteristics and is capable of being constructed and realized with simple circuitry supported by an accurate design technique.

The distributed element filter of the invention is based on a distributed element filter with band pass characteristics, realized by an unbalanced distributed constant circuit and obtained by a frequency transform from a low pass prototype filter whose transfer function is expressed by a circuit network function consisting of a numerator rational polynomial, which is an even function of complex frequency s and has a pair of plus and minus real zeros or a pair of conjugate purely imaginary zeros, and a denominator rational polynomial, which is a Hurwitz polynomial of the complex frequency s.

As shown in FIGS. 1A to 1D given later, the invention provides a distributed element filter comprising:

n half wavelength of a passband center frequency, microstrip resonators (L, H) consisting of straight and hairpin microstrip lines (L, H) wherein n is an even number equal to or more than 4, the n half wavelength microstrip resonators (L, H) being connected sequentially with each resonator coupled with adjacent resonators over a length of approximately one quarter wavelength, respective numbers of straight microstrip lines (L) and hairpin microstrip lines (H) of the n half wavelength microstrip resonators (L, H) being both odd;

an external circuit connection quarter wavelength straight microstrip lines (M) coupled to first and n-th half wavelength microstrip resonators (L1, L4; H1, H4), respectively; and a cross coupling circuit (C) connected to ends of the first and n-th half microstrip resonators (L1, L4; H1, H4), the ends being of a side on which the first and n-th half microstrip resonators (L1, L4; H1, H4) are coupled with the external circuit connection quarter wavelength straight microstrip lines (M) (FIGS. 1B, 1D), or to ends of the external circuit connection quarter wavelength straight microstrip lines (M) (FIGS. 1A, 1C).

According to the distributed element filter of the invention, the n half wavelength straight or hairpin microstrip resonators are connected sequentially with each resonator coupled with adjacent resonators over a length of approximately one quarter wavelength, the number of straight microstrip lines and the number of hairpin microstrip lines both being set odd, while the external circuit connection straight microstrip lines, each having approximately one quarter wavelength, are coupled to the first and n-th half wavelength microstrip resonators, respectively, and the cross coupling circuit is connected to the ends of the first and n-th half microstrip resonators, which ends are of a side on which the first and n-th half microstrip resonators are coupled with the external circuit connection quarter wavelength straight microstrip, or to the ends of the external circuit connection quarter wavelength straight microstrip lines. This enables the cross coupling circuit to be connected on the same plane without using a three dimensional structure, and the zeros of the numerator rational polynomial, that is, transmission zeros can be realized as transmission zeros of the transmission characteristics of the filter.

Furthermore, by adding an electric field or magnetic field cross coupling circuit to a multi-resonator band pass filter constructed with n resonators, it becomes possible to form desired attenuation poles and to adjust the amplitude characteristic and group delay time. Moreover, by using the cross coupling circuit to control the phase of the transmission characteristic between the resonators, desired attenuation poles can be formed and the amplitude characteristic and group delay time adjusted using only the cross coupling circuit of nearly the same type, which facilitates the realization of a distributed element filter having the desired characteristics.

Further, when n is 6 or larger, the cross coupling can be implemented in the form of multiple cross coupling such as double or triple, or even in the form of a cascade connection of a plurality of multi-resonator filters including the cross coupling.

As a result, a distributed element filter can be provided that has band pass characteristics achieving, without impairing the advantage of the distributed element filter of the planar structure, both a flat amplitude and a flat group delay over the passband, while at the same time, realizing transmission zeros in the stopbands, and that has low sensitivity and low loss characteristics and is capable of being constructed and realized with simple circuitry supported an accurate design technique.

In the invention it is preferable that, as shown in FIGS. 2A to 2D, at least one of the half wavelength microstrip resonators is replaced by a one-wavelength microstrip resonator (H11).

According to the distributed element filter of the invention, since replacing at least one of the half wavelength microstrip resonators by a one-wavelength microstrip resonator in the above configuration achieves the effect of reversing the phase of the transmission characteristics of the multi-resonator filter in a controlled manner, the cross coupling circuit can be added exactly as intended by the design.

According to the distributed element filter of this invention, since, in design theory, the circuit block corresponding to the real zeros or imaginary zeros of the numerator rational polynomial of the circuit network function describing the transfer characteristic is implemented by the multi-resonator filter of the above configuration, a filter circuit that is theoretically accurate and is simple in structure, and that provides improved performance allowing low losses and has the desired filter characteristics, can be constructed and realized using distributed constant elements on the same plane without using a three dimensional structure.

The transmission zero corresponding to zero on the imaginary axis of the transfer function can be realized by applying cross couplings to the coupling/connection between the resonators, and the amplitude by zeros on the real axis of the transfer function can be modified. The zero on the imaginary axis and the zero on the real axis can be realized by the cross coupling circuits of nearly the same structure. Consequently the phase of the transmission characteristics can be easily controlled. As a result, a band pass filter having characteristics that achieve both a flat amplitude and a flat group delay over the passband, and that realizes transmission zeros (attenuation poles) in the stopbands, can be realized with simple circuitry.

In the invention it is preferable that the distributed element filter has band pass characteristics in which both of amplitude characteristics and group delay characteristics of the passband are flat and a transmission zero is in a stopband thereof.

As described above, according to the invention, a distributed element filter can be provided that has band pass characteristics achieving, without impairing the advantage of the distributed element filter of the planar structure, both the flat amplitude and the flat group delay over the passband, while at the same time, realizing transmission zeros in the stopband, and that has low sensitivity and low loss characteristics and is capable of being constructed and realized with simple circuitry supported by an accurate design technique.

As shown in FIGS. 12A to 15 given later, the invention provides a distributed element filter comprising:

n half wavelength corresponding to a passband center frequency, microstrip resonators (L, H) consisting of straight and hairpin microstrip lines (L, H) wherein n is an even number equal to or more than 4, the n half wavelength microstrip resonators (L, H) being connected sequentially with each resonator coupled with adjacent resonators over a length of approximately one quarter wavelength, respective numbers of straight microstrip lines (L) and hairpin microstrip lines (H) of the n half wavelength microstrip resonators (L, H) being both odd;

an external circuit connection quarter wavelength straight microstrip lines (M) coupled to first and n-th half wavelength microstrip resonators (L1, L4; H1, H4; H1*a*, H4*a*; H1*b*, H4*b*), respectively; and a cross coupling circuit (C, C1, C1*a*, C1*b*,) consisting of an a/2 wavelength microstrip line (u1, u3, u5, u7, u9, u11, u3*a*, u9*b*) and a b/2 wavelength microstrip line (u2, a4, u6, u8, u10, u12, u4*a*, u10*b*) capacitively coupled via a slit (g1, g2, g1*a*, g1*b*) (a and b are natural numbers), the cross coupling circuit (C) being connected to ends of the first and n-th half microstrip resonators (L1, L4; H1, H4), the ends being of a side on which the first and n-th half microstrip resonators (L1, L4; H1, H4) are coupled with the external circuit connection quarter wavelength straight microstrip lines (M), or to ends of the external circuit connection quarter wavelength straight microstrip lines (M1, M4, M1*a*, M4*a*, M1*b*, M4*b*).

According to the distributed element filter of the invention, the n half wavelength straight or hair pin microstrip resonators are connected sequentially with each resonator coupled with adjacent resonators over a length of approximately one quarter wavelength, the number of straight microstrip lines and the number of hairpin microstrip lines both being set odd, while the external circuit connection straight microstrip lines, each having approximately one quarter wavelength, are coupled to the first and n-th half wavelength microstrip resonators, respectively, and the cross coupling circuit consisting of an a/2 wavelength microstrip line and a b/2 wavelength microstrip line capacitively coupled via a slit (a and b are natural numbers) is connected to the ends of the first and n-th half microstrip resonators, which ends are of a side on which the first and n-th half microstrip resonators are coupled with the external circuit connection quarter wavelength straight microstrip, or to the ends of the external circuit connection quarter wavelength straight microstrip lines. This enables the cross coupling circuit to be formed on the same plane without using a three dimensional structure, and the zeros of the numerator rational polynomial, that is, real transmission zeros or imaginary transmission zeros can be realized.

Furthermore, by adding an electric field or magnetic field cross coupling circuit to a sequential multi-resonator band pass filter constructed with n resonators, it becomes possible to form desired attenuation poles and to adjust the amplitude characteristic and group delay times. Moreover, by using the similar cross coupling circuit to adjust the phase of the transmission characteristic between the resonators, desired attenuation poles can be also formed. The amplitude characteristic and group delay time can be therefore adjusted using the cross coupling circuits of nearly the same structure, which facilitates the realization of a distributed element filter having the desired characteristics.

Further, when n is 6 or larger, the cross coupling can be also implemented in the form of multiple cross coupling such as double or triple, while the cross coupling is implemented also in the form of a cascade connection of a plurality of multi-resonator filters including a single cross coupling.

As a result, a distributed element filter can be provided that has band pass characteristics achieving, without impairing the advantage of the distributed element filter of the planar structure, both a flat amplitude and a flat group delay over the passband, while at the same time, realizing transmission zeros in the stopbands, and that has low sensitivity and low loss characteristics and is capable of being constructed and realized with simple circuitry supported by an accurate design technique.

In the invention it is preferable that as shown in FIG. 14, in the plurality of distributed element filters (71, 72) the external circuit connection quarter wavelength straight microstrip lines (M1, M4, M1*a*, M4*a*) are connected in cascade, and at least one of the respective values of (a+b) for the microstrip line (M1, M4, M1*a*, M4*a*) in the cross coupling circuit (C1, C1*a*) of the plurality of distributed element filters (71, 72) is odd and at least one thereof is even.

According to the distributed element filter of this invention, a plurality of distributed element filters according to the invention are connected as filter blocks in cascade; when these filter blocks are identical in configuration, since the value of (a+b) for the cross coupling circuit is chosen to be odd in one filter block and even in another filter block, the respective cross coupling circuits become equivalent to electric field coupling and magnetic field coupling or magnetic field coupling and electric field coupling, and it follows that the filter blocks having complementary cross coupling are connected in cascade.

In the invention it is preferable that, as shown in FIG. 15, in a plurality of the distributed element filters (73, 74) the external circuit connection quarter wavelength straight microstrip lines (M1, M4, M1*b*, M4*b*) are connected in cascade, and at least one of the half wavelength microstrip resonators is replaced by a one-wavelength microstrip resonator (H21*b*).

According to the distributed element filter of this invention, in a plurality of the distributed element filters according to the invention, the external circuit connection quarter wavelength straight microstrip lines are connected in cascade, and at least one of the half wavelength microstrip resonators is replaced by a one-wavelength microstrip resonator. Accordingly, addition of the same type of cross coupling circuits makes it possible to form desired attenuation poles and adjust the amplitude characteristics and group delay times with the result that a distributed element filter having desired characteristics can be realized. Since this makes it possible to form attenuation poles, or to flatten the amplitude or/and to adjust the group delay times by using the cross coupling circuit in each filter block, thus flattening the amplitude and group delay characteristics over the passband while realizing attenuation poles in the stopbands, the distributed element filter thus constructed can, as a whole, achieve the desired passband as well as stopband characteristics.

In the invention it is preferable that the distributed element filter has band pass characteristics in which both of amplitude characteristics and group delay characteristics of the passband are flat and transmission zeros are formed in a stopband thereof.

According to the distributed element filter of this invention, since, in design theory, the circuit block corresponding to the real zeros or imaginary zeros of the numerator rational polynomial of the circuit network function describing the transfer characteristic is implemented by the multi-resonator filter of the above configuration, a filter circuit that is theoretically accurate and is simple in structure, and that provides improved performance allowing low losses and has the desired filter characteristics, can be constructed and realized using distributed constant elements on the same plane without using a three dimensional structure.

As described above, according to the invention, transmission zeros corresponding to zeros on the imaginary axis of the transfer function can be realized by forming a cross coupling circuit for the coupling/connection between the microstrip resonators, and the amplitude can be adjusted corresponding to zeros on the real axis of the transfer function. In connection with this adjustment, the phase of the transfer characteristic can also be easily controlled. As a result, a distributed element filter having both a flat amplitude characteristics and a flat group delay characteristics over the passband and transmission zeros (attenuation poles) in the stopbands, can be realized with simple circuitry.

Further, according to the invention, a distributed element filter can be provided that has band pass characteristics achieving, without impairing the advantage of the distributed element filter of the planar structure, both a flat amplitude and a flat group delay over the passband, while at the same time, realizing transmission zeros in the stopbands, and that has low sensitivity and low loss characteristics and is capable of being constructed and realized with simple circuitry supported by an accurate design technique.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
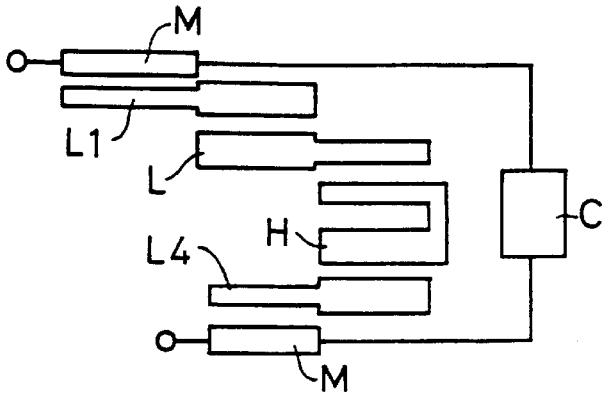
FIGS. 1A to 1D are plan views showing examples of a first embodiment of a distributed element filter according to the invention.

Now referring to the drawings, preferred embodiments of the invention are described below.

Examples of a distributed element filter according to a first embodiment of the invention are shown in FIGS. 1A to 1D and FIGS. 3 to 11.

In the following description, circuit network functions are expressed using s parameters, as shown in equation (1) below.

$$(S) - \begin{pmatrix} s_{11} & s_{12} \\ s_{21} & s_{22} \end{pmatrix} = \begin{pmatrix} \frac{h(s)}{g(s)} & \frac{f(s)}{g(s)} \\ \frac{t(s)}{g(s)} & \frac{-h_v(s)}{g(s)} \end{pmatrix} \quad (1)$$

A design example of a filter achieving both flat amplitude and flat group delay characteristics over the passband and having transmission zeros in the stopbands will be described below as one example of the distributed element filter according to the invention.

In this filter example, the numerator rational polynomial f(s) of the circuit network function $s_{21}$ describing the transfer characteristic of the filter is of fourth order, and the denominator rational polynomial g(s) is of eighth order.

If the filter is lossless, then the S matrix is a unitary matrix, and the remaining polynomial h(s) is determined. This determines the input impedance or input admittance and, expanding these to a ladder circuit, a low pass prototype filter is obtained. An example of this is shown in the circuit diagram of FIG. 3.

Here, the order of the denominator g(s) corresponds to a number of stages in the ladder circuit; in the example shown, since the order is 8, the number of stages is 8. A number of pairs of zeros of the numerator rational polynomial represents the number of resonator circuits connected in parallel or series so that transmission zeros (attenuation poles) can be formed; in the illustrated example, the number is 2.

Figure 4:
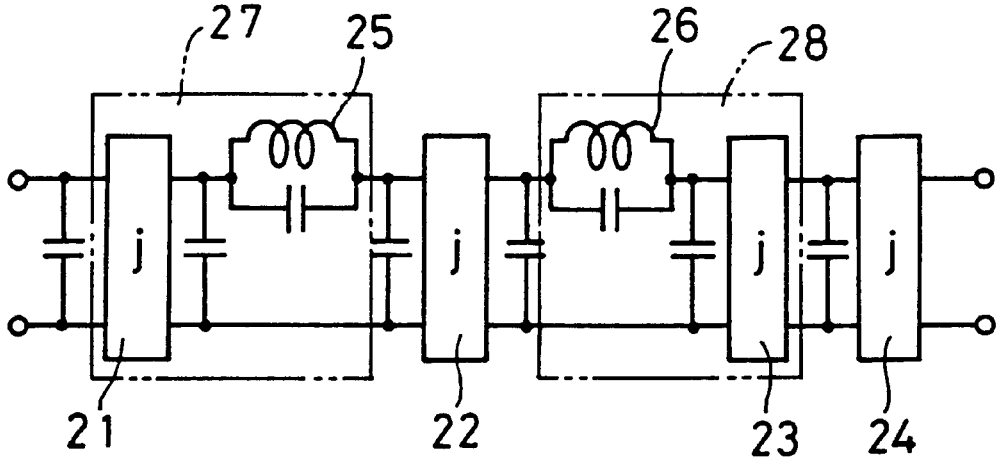
FIG. 4 is a circuit diagram showing an example of an equivalent transformation of the low pass prototype filter shown in FIG. 3.
Figure 5A:
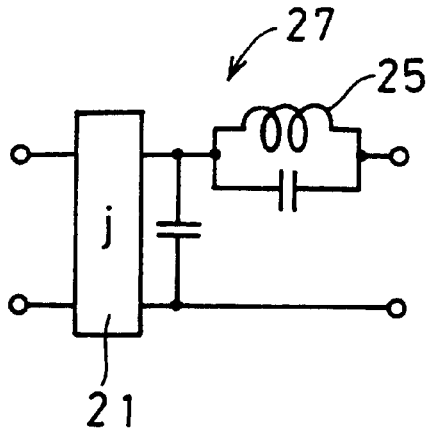
FIGS. 5A and 5B are circuit diagrams showing an example of equivalent transform of the circuit of FIG. 5A into the form shown in FIG. 5B containing a cross coupling circuit.
Figure 5B:
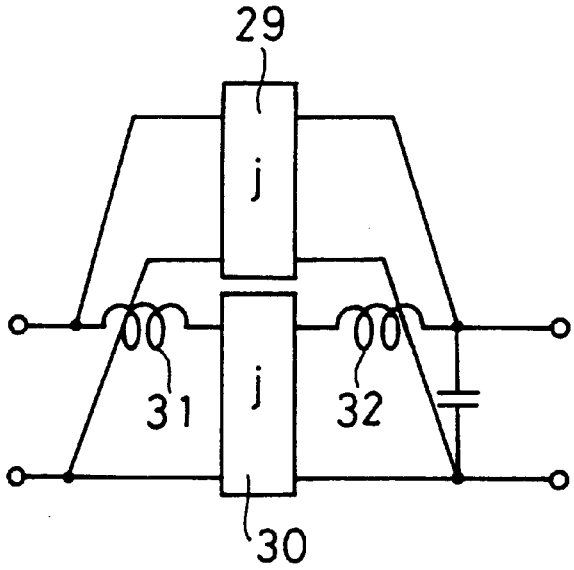

This low pass prototype filter is equivalently transformed using imaginary gyrators 21 to 24, into a low pass prototype filter such as shown in the circuit diagram of FIG. 4. In FIG. 4, the sign, positive or negative, is not indicated for the imaginary gyrators, because either it would be useless to specify the sings of the imaginary gyrators or the imaginary gyrators can take both positive and negative signs. This convention is used throughout the drawings hereinafter given.

The two parallel resonator circuits 25, 26 shown in FIG. 4 correspond to the zeros of the numerator rational polynomial f(s) of $s_{21}$. Further, the portions 27, 28 enclosed by dashed lines in FIG. 4 are each transformed from the circuit shown in FIG. 5A to an equivalent circuit shown in FIG. 5B that contains a cross coupling circuit. In the equivalent transformation from FIG. 5A to FIG. 5D, the positive/negative signs of the imaginary gyrators becomes opposite for the case of the pair of zeros on the real axis and the case of the pair of zeros on the imaginary axis. By applying the equivalent transformation from FIG. 5A to FIG. 5B, the circuit of FIG. 4 is transformed to an equivalent low pass prototype filter such as shown in the circuit diagram of FIG. 6.

Figure 6:
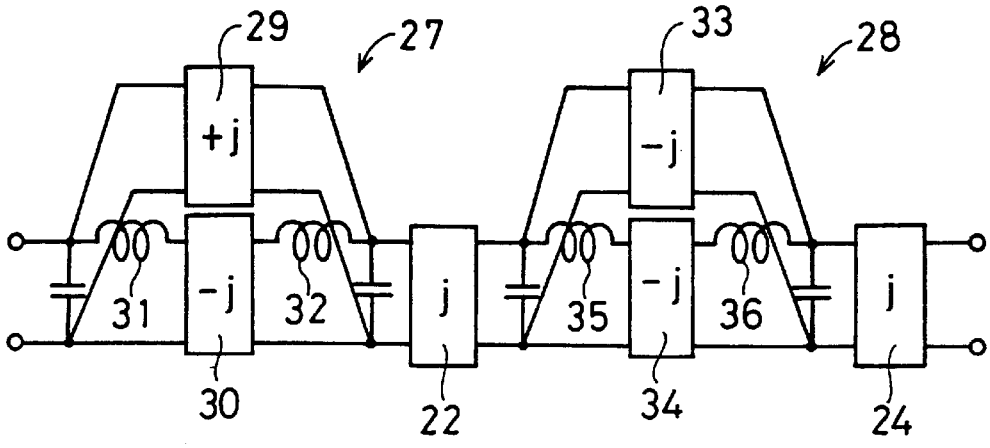
FIG. 6 is a circuit diagram showing an example of a low pass prototype filter obtained by transforming the circuit shown in FIG. 4 into the equivalent circuit containing the cross coupling circuit shown in FIGS. 5A and 5B.

Further, using imaginary gyrators 37, 38; 39, 40, the inductors 31, 32; 35, 36 in FIG. 6 are transformed to equivalent capacitors. The circuit diagram of the resulting low pass prototype filter is shown in FIG. 7.

Figure 7:
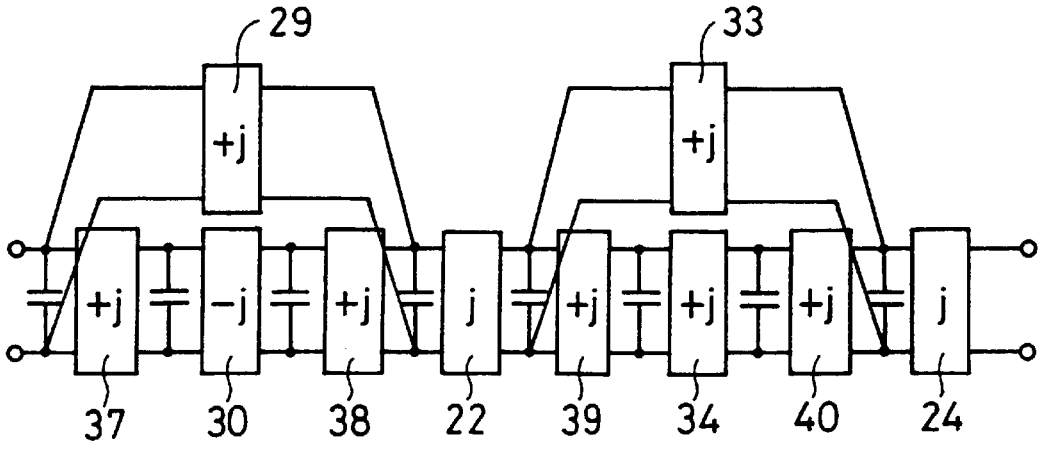
FIG. 7 is a circuit diagram showing an example of a low pass prototype filter obtained by transforming inductors in the circuit shown in FIG. 6 into equivalent capacitors.

In FIG. 7, freedom is allowed in the selection of the positive/negative signs of the imaginary gyrators 29, 30, 33, 34, 37 to 40, First, the imaginary gyrators 30, 34 of the sequentially coupling circuits in FIG. 6 are equivalently transformed so that the gyrators will have the same sign wherever possible. In the illustrated example, both gyrators are made negative in sign. On the other hand, the imaginary gyrators 29, 33 for cross coupling in FIG. 6 are, in the illustrated example, opposite in sign to each other.

Since the imaginary gyrators 29, 33 of the cross coupling circuits differ in sign, the circuit of FIG. 6 is difficult to be implemented in a practical circuit. For the distributed element filter of the invention, therefore, the following transformations are further performed.

First, as shown in FIG. 7, the sequentially coupling imaginary gyrators 37, 30, 38, 39, 34, 40 are made identical in sign wherever possible by performing equivalent transformation. In the illustrated example, as many gyrators as possible are made positive in sign. Further, the cross coupling imaginary gyrators 29, 33 in FIG. 7 are made identical in sign. In the illustrated example, both gyrators are made positive in sign.

Figure 8A:
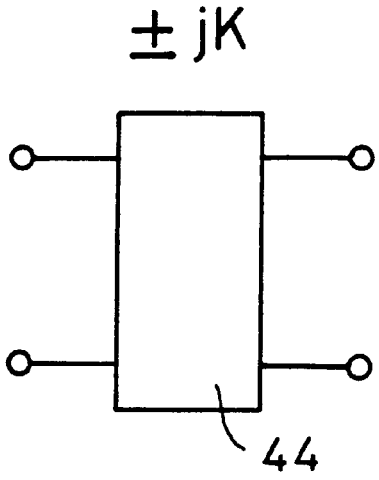
FIGS. 8A and 8B are circuit diagrams showing an example of equivalent transform of an imaginary gyrator in FIG. 8A into a $\pi$-type equivalent circuit of constant reactance elements shown in FIG. 8B.
Figure 8B:
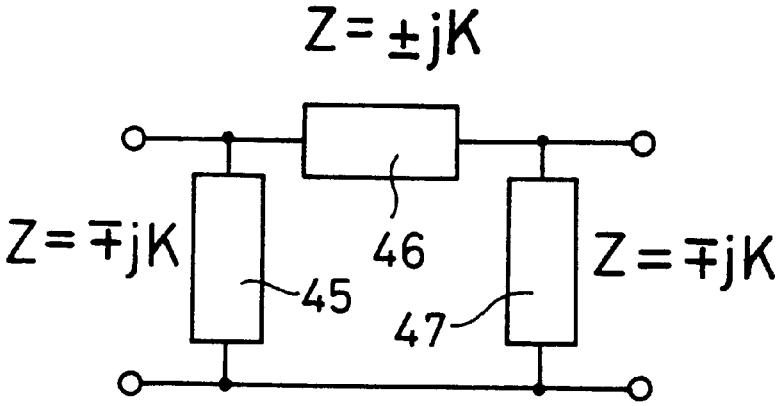

Considering the sign of an imaginary gyrator, the imaginary gyrator 44 shown in FIG. 8A can be implemented as a π-type equivalent circuit of constant reactance elements 45 to 47 shown in FIG. 8B.

Figure 9:
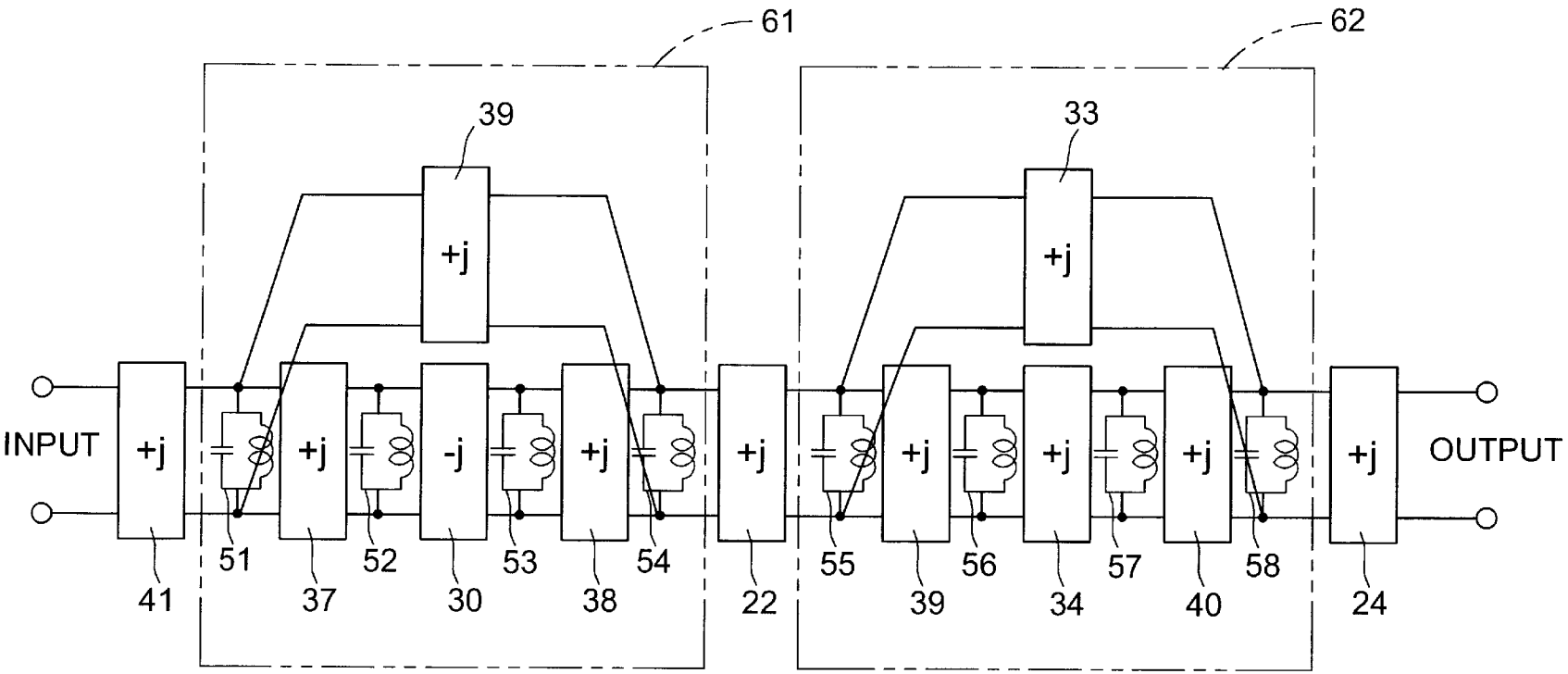
FIG. 9 is a circuit diagram showing an example of a band pass filter obtained by equivalent transform of the low pass prototype filter.

Here, when a frequency transformation is applied to transform the low pass prototype filter of FIG. 7 into a band pass filter, the band pass filter shown in the circuit diagram of FIG. 9 is obtained. In the illustrated example, an imaginary gyrator 41 is inserted at each input port to improve the symmetry of the structure between the input and output port. In this case, the input impedance is transformed to the input admittance, but the transmission characteristic of the filter remains unchanged. In the band pass filter shown, eight resonators 51 to 58 are sequentially coupled through the imaginary gyrators 41, 37, 30, 38, 22, 29, 34, 40, 24, and transmission zeros are realized by the two cross coupling circuits 29, 33. The gyrators 29, 33 acting as the cross coupling circuits are both made positive in sign.

In the circuit of FIG. 9, though designated by different reference numerals, the right half 61 and let half 62 of the circuit diagrams are similar in configuration, the only difference being that the imaginary gyrators 30, 34 located at the center in the respective sequentially coupling circuits are opposite in sign to each other. Therefore, in the band pass filter of such circuit configuration, the right half circuit 61 and the left half circuit 62 can be constructed from identical circuits if a circuit for reversing the sign of the imaginary gyrator 30, 34 is added to the center of the sequentially coupling circuit. This facilitates the realization of a practical circuit since the cross coupling circuit blocks 29, 33 can be made almost identical in structure.

Since the right half circuit 61 and the left half circuit 62 can be constructed from identical circuits by adding a circuit for reversing the sign of the imaginary gyrator 30, 34 to the center of the sequentially coupling circuit, as described above, the cross coupling blocks 29, 33 can be made identical in circuit structure, facilitating the realization of the circuit. That is, by adding a circuit having the function of reversing the phase of the transmission characteristic to the center section 30, 34 of the distributed element filter constructed with sequentially coupled elements, the phase of the transmission characteristic of the band pass filter can be controlled, and by connecting the cross coupling circuits that utilize electric or magnetic field coupling, it becomes possible to control attenuation poles, amplitude, and group delay times. In this way, by adding a circuit having the function of reversing the phase of the transmission characteristic to the center section of the sequentially coupled filter, the phase of the transmission characteristic of the filter can be controlled.

Next, consider the case where the right half sequentially coupling circuit 61 and the left half sequentially coupling circuit 62 in the circuit diagram of FIG. 9 are constructed from circuits that are identical in general configuration but differ only in the configuration of the phase inverter included in the center section 30, 34.

Figure 10:
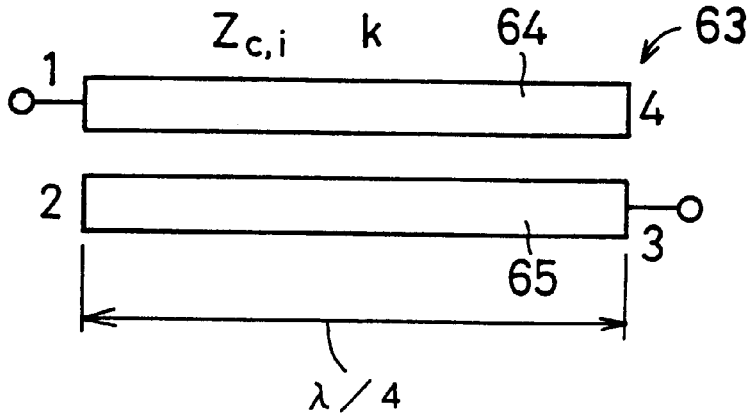
FIG. 10 is a plan view showing a pair of $\lambda/4$ coupled microstrip lines forming a microstrip resonator.

Here, as shown in the plan view of FIG. 10, consider a pair of λ/4 coupled microstrip lines 64, 65 forming a microstrip resonator 63, in which connection ports at one end are designated as port 1 and port 3 and ports at the other end are designated as port 2 and port 4. In this pair of λ/4 coupled microstrip lines 64, 65, port 2 and port 4 are open, and port 1 and port 2 are regarded as a set of ports. $Z_{c,1}$ and $k_1$ denote the characteristic impedance and the coupling coefficient, respectively. Then, F matrix between port 1 and port 2 is given by equation (2) below.

$$(F) = \begin{pmatrix} \dfrac{\cos\left(\frac{\pi}{2}\frac{\omega}{\omega_0}\right)}{k_i} & j\dfrac{k_i^2 - \cos^2\left(\frac{\pi}{2}\frac{\omega}{\Omega_0}\right)}{k_i\sqrt{1-k_i^2}\,\sin\left(\frac{\pi}{2}\frac{\omega}{\omega_0}\right)}Z_{c,i} \\ j\dfrac{\sqrt{1-k_i^2}}{Z_{C,1}k_i}\sin\left(\frac{\pi}{2}\frac{\omega}{\omega_0}\right) & \dfrac{\cos\left(\frac{\pi}{2}\frac{\omega}{\omega_0}\right)}{k_i} \end{pmatrix} \tag{2}$$

Figure 11:
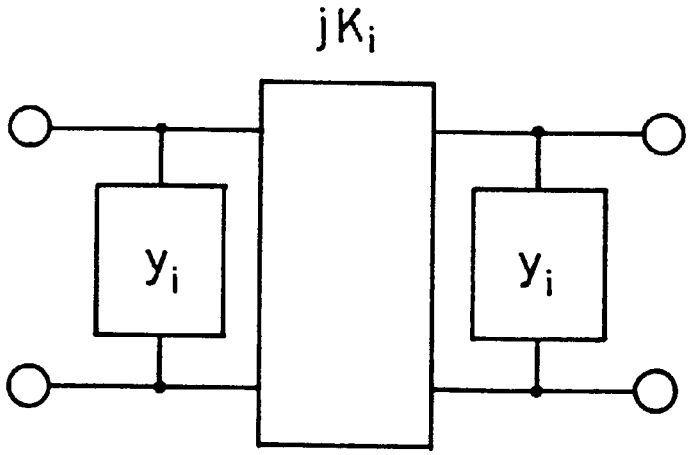
FIG. 11 is a circuit diagram showing a narrowband equivalent circuit of $\lambda/4$ coupled microstrip lines.

An example of an equivalent circuit for the F matrix is a narrowband approximation equivalent circuit of λ/4 coupled microstrip lines, such as shown in the circuit diagram of FIG. 11. The F matrix for the circuit shown in FIG. 11 is given by equation (3).

$$(F) = \begin{pmatrix} jK_i y_i & jK_i \\ j\dfrac{1}{K_i} + jK_i y_i^2 & jK_i y_i \end{pmatrix} \tag{3}$$

Next, in the low pass prototype filter, $y_1 = j\omega \cdot p_i$, and a frequency transformation is applied to transform the low pass prototype filter to a band pass filter with center frequency ω0 and bandwidth Δ. This means transforming the parallel capacitors in FIG. 7 to the parallel resonant circuits 51 to 58 in FIG. 9. By applying this condition directly to equations (2) and (3) and applying narrowband approximation to these matrix components, the coupling coefficient $k_i$ and characteristic impedance $Z_{e,i}$ shown by equations (4) and (5) below are determined.

$$k_i = \frac{\Delta\pi}{4\omega_0 K_i p_i} \tag{4}$$

$$Z_{c,i} = \frac{K_i\sqrt{1-k_i^2}}{k_i} \tag{5}$$

That is, the circuit containing each imaginary gyrator, 37, 30, 38, 22, 29, 34, 40, 29, 33, and parallel resonators, 51 to 58, connected in parallel to each imaginary gyrator, is approximately equivalent to a λ/4 coupled microstrip line.

Figure 1B:
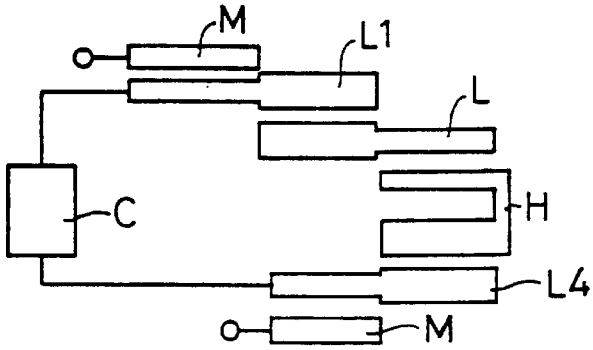
Figure 1C:
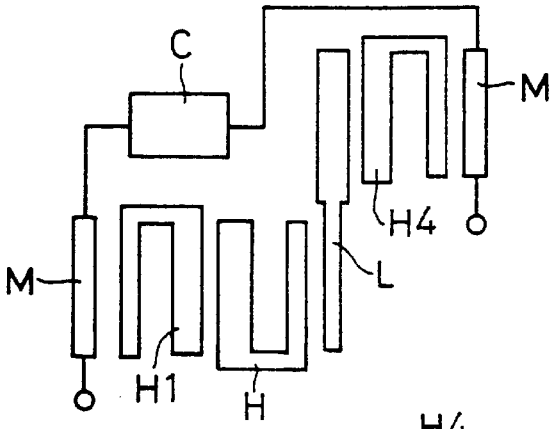
Figure 1D:
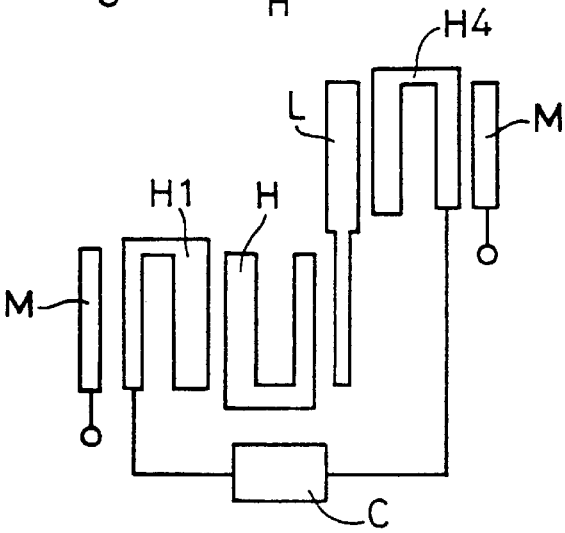
Figure 2A:
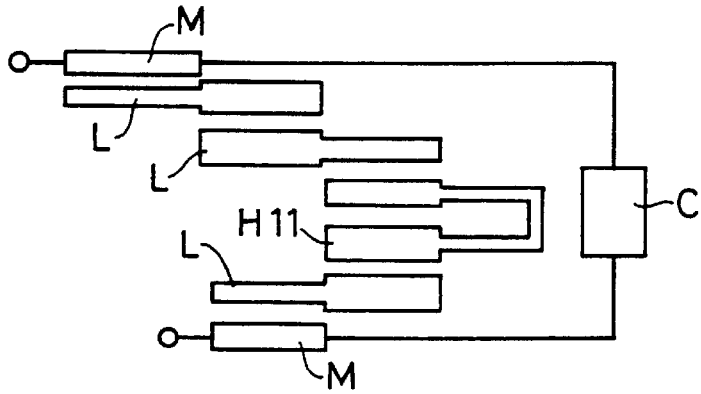
FIGS. 2A to 2D are plan views showing examples of a second embodiment of the distributed element filter of the invention.
Figure 2B:
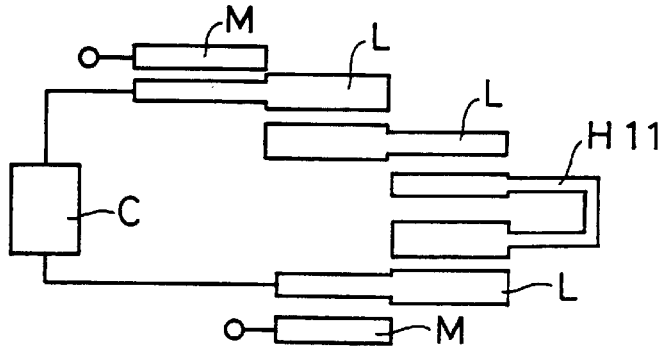
Figure 2C:
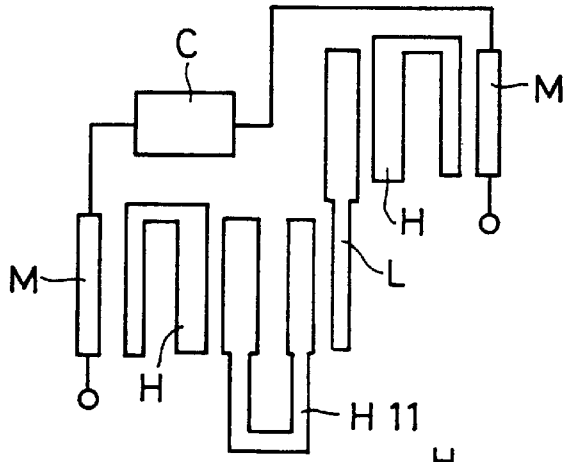
Figure 2D:
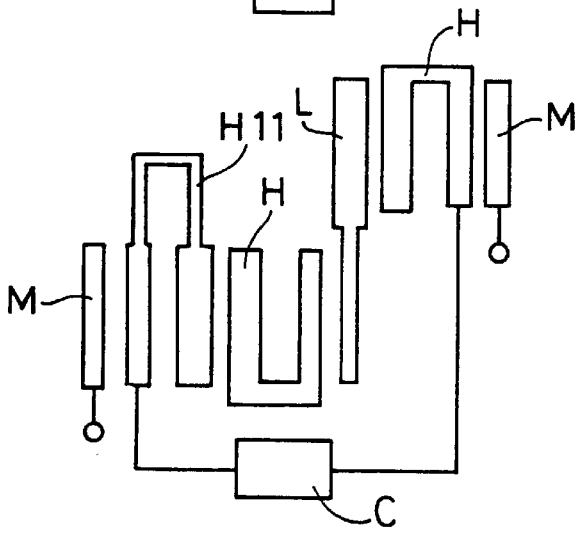
Figure 3:
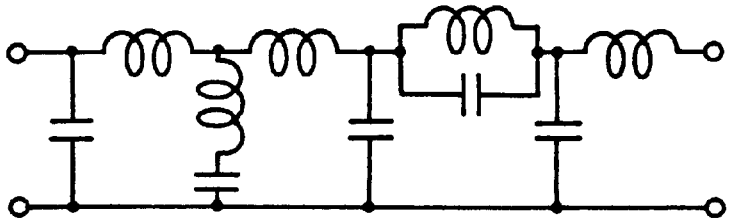
FIG. 3 is a circuit diagram showing an example of an eighth order low pass prototype filter.

Four examples of the first embodiment of the distributed element filter of the invention, constructed using the above approximation, are shown in the plan views of FIGS. 1A to 1D, in which four half wavelength microstrip resonators L and H are sequentially connected, quarter wavelength straight microstrip lines M for external circuit connection are coupled to the first and fourth half wavelength microstrip resonators, and a cross coupling circuit is connected to the quarter wavelength straight microstrip lines M (FIGS. 1A and 1C) or to the ends of the first and fourth half wavelength microstrip resonators coupled to the quarter wavelength straight microstrip lines M (FIGS. 1B and 1D).

In these examples, bent hairpin-like strip line resonators H are also used; derivation of the parameter cannot be expressed in a simple analytical form, but basically, the parameter can be derived by transforming equation (4) and (5). How this is done will not be described in detail here.

The right half circuit 62 of the equivalent circuit shown in FIG. 9, containing the center imaginary gyrator 34, is a multi-resonator band pass filter constructed with four half wavelength microstrip resonators. The resonators are sequentially connected using quarter wavelength microstrip lines 64, 65 such as shown in FIG. 10; various realizations of the first embodiment of the distributed element filter of the invention are shown in the examples of FIGS. 1A to 1D.

In the example of FIG. 1A, three half wavelength microstrip resonators L, each formed from a straight microstrip line, and one half wavelength microstrip resonator H, formed from a hairpin microstrip line, are sequentially connected, the quarter wavelength straight microstrip lines M for external circuit connection are coupled to the first and fourth half wavelength resonators L1, L4, and the cross coupling circuit C is connected to the quarter wavelength straight microstrip lines M. Hereinafter, reference characters suffixed with numbers may be generally referred to with the first alphabetic character by omitting the suffix.

In the example of FIG. 1B, three resonators L, each formed from a straight microstrip line, and one resonator H, formed from a hairpin microstrip line, are sequentially connected, the quarter wavelength straight microstrip lines M are coupled to the first and fourth resonators L1, L4, and the cross coupling circuit C connected to the ends of the first and fourth resonators L1, L4 coupled to the quarter wavelength straight microstrip lines M.

In the example of FIG. 1C, one half wavelength microstrip resonator L, formed from a straight microstrip line, and three half wavelength microstrip resonator H, each formed from a hairpin microstrip line, are sequentially connected, the quarter wavelength straight microstrip lines M for external circuit connection are coupled to the first and fourth resonators H1, H4, and the cross coupling circuit C is connected to the quarter wavelength straight microstrip lines M.

In the example of FIG. 1D, one resonator L, formed from a straight microstrip line, and three resonators H, each formed from a hairpin microstrip line, are sequentially connected, the quarter wavelength straight microstrip lines M are coupled to the first and fourth resonators H1, H4, and the cross coupling circuit C is connected to the ends of the first and fourth resonators H1, H4 coupled to the quarter wavelength straight microstrip lines M.

As can be seen from the above realizations of the distributed element filter of the invention, the cross coupling circuit C can be connected to the intended ports without crossing any of the resonators L, H, and thus the band pass filter can be realized while retaining its planar circuit structure.

In comparison with the examples of the distributed element filter of the invention shown in FIGS. 1A to 1D, four examples of a second embodiment of the distributed element filter of the invention are illustrated in the plan views of FIGS. 2A to 2D; in the second embodiment, one of the half wavelength microstrip resonators in the first embodiment is replaced by a one-wavelength microstrip resonator by adding a half wavelength phase shifter. The illustrated circuits here each correspond to the left half circuit 61 containing the center imaginary gyrator 30 in the equivalent circuit shown in FIG. 9.

The examples illustrated in FIGS. 2A to 2D differ from those shown in FIGS. 1A to 1D in that one half wavelength microstrip resonator H formed from a hairpin microstrip line is replaced by a one-wavelength microstrip resonator H11 which is also formed from a hairpin microstrip line.

Since replacing at least one of the half wavelength microstrip resonators by the one-wavelength microstrip resonator H11 achieves the effect of reversing the phase of the transmission characteristics of the sequentially coupled multi-resonator filter in a controlled manner, a cross coupling circuit C designed exactly as intended can be added.

When replacing at least one of the half wavelength microstrip resonators by the one-wavelength microstrip resonator H11, since the one-wavelength microstrip resonator H11 is equivalent in function to a half wavelength microstrip resonator with a half wavelength phase shifter added to it, the number of replacing resonators H11 should preferably be made odd.

Each distributed element filter shown in FIGS. 1A to 1D and each distributed element filter shown in FIGS. 2A to 2D are circuit blocks respectively corresponding to circuits containing zeros on the real axis and zeros on the imaginary axis of the numerator polynomial of the circuit network function $s_2$ representing the transfer function. By cascading each circuit shown in FIGS. 1A to 1D with each circuit shown in FIGS. 2A to 2D, the band pass filter shown in the equivalent circuit of FIG. 9 can be realized as a planar circuit formed on the same plane.

Six examples according to a third embodiment of the distributed element filter of the invention are shown in the plan views of FIGS. 12A to 12C and 13A to 13C.

Figure 12A:
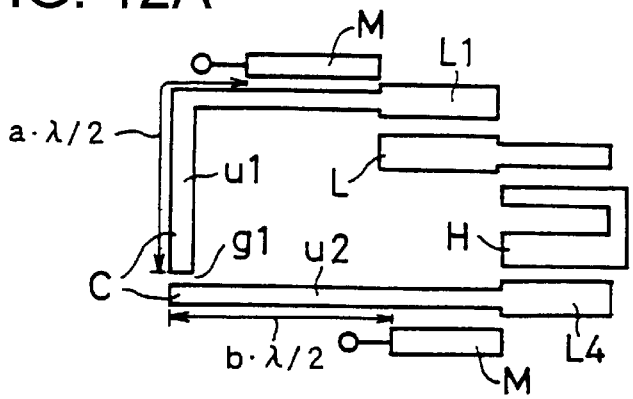
FIGS. 12A to 12C are plan view showing examples of a third embodiment of the distributed element filter of the invention.
Figure 12B:
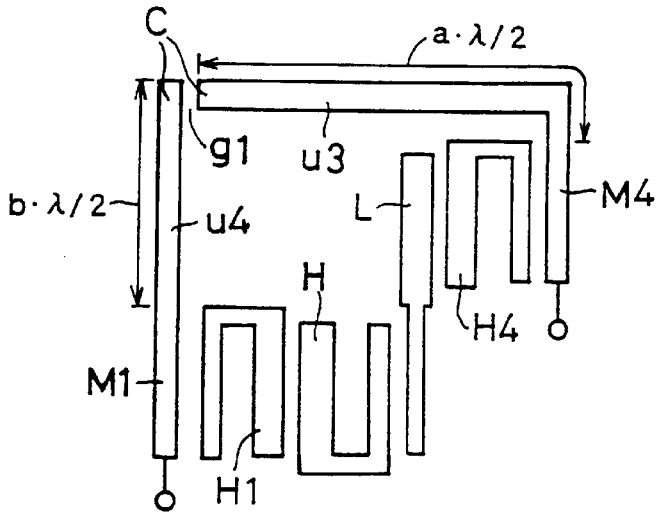
Figure 12C:
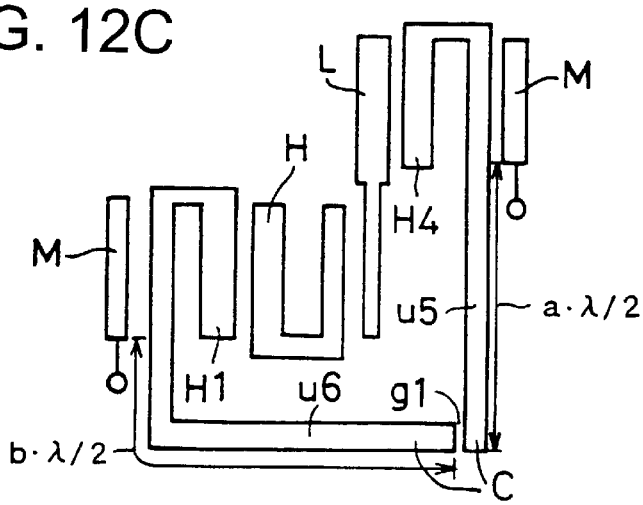

In each of the examples of FIGS. 12A to 12C, a cross coupling circuit C consisting of an a/2 wavelength microstrip line u1, u3, u5 and a b/2 wavelength microstrip line u2, u4, u6 (a and b are natural numbers), capacitively coupled via a slit g1, is added to a fourth order sequentially connected band pass filter L, H. The cross coupling circuit C is formed, in FIG. 12A, between the first and fourth half wavelength straight microstrip resonators L1, L4; in FIG. 12C, between the half wavelength hairpin microstrip lines H1, H4; and in FIG. 12B, between the external circuit connection quarter wavelength straight microstrip lines M1, M4 formed together with the first and fourth half wavelength microstrip resonators H1, H4.

In each distributed element filter, the cross coupling circuit includes a slit g1 formed between the a/2 wavelength microstrip line and b/2 wavelength microstrip line, and by capacitive coupling via this slit g1, the circuit becomes equivalent to a configuration in which a capacitive element is connected in series as a reactance element. The first to fourth half wavelength microstrip resonators L, H are connected sequentially with each resonator coupled with adjacent resonators over a distance of approximately one quarter wavelength; since there is no phase inverting circuit inserted here, the switching of the sign of the reactance element in the cross coupling circuit C is accomplished by switching the value of (a+b) between an odd number and an even number.

The three examples of the third embodiment of the distributed element filter of the invention shown in the plan views of FIGS. 12A to 12C are constructed using the approximations given by equations (1) to (5), as in the first embodiment described with reference to FIGS. 1A to 1D; that is, the four half wavelength microstrip resonators L, H are sequentially connected, the quarter wavelength straight microstrip lines M for external circuit connection are coupled to the first and fourth half wavelength microstrip resonators L1, H1; L4, H4, and the cross coupling circuit consisting of the a/2 wavelength microstrip line u1, u5, u3 and b/2 wavelength microstrip line u2, u6, u4 is connected to the quarter wavelength straight microstrip lines M (FIG. 12D) or to the ends of the first and fourth half wavelength microstrip resonators coupled to the quarter wavelength straight microstrip lines M (FIGS. 12A and 12C).

In these examples, bent hairpin-like strip line resonators H are also used; derivation of the parameter cannot be expressed in a simple analytical form, but basically, the parameter can be derived by transforming equations (4) and (5). How this is done will not be described in detail here.

Figure 13A:
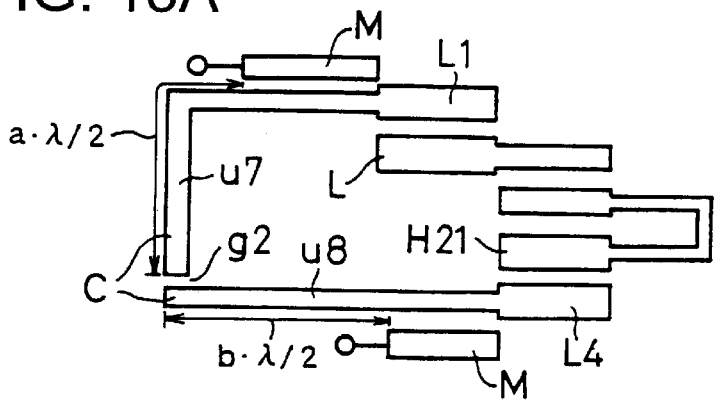
FIGS. 13A to 13C are plan view showing alternative examples of the third embodiment of the distributed element filter according to the invention.
Figure 13B:
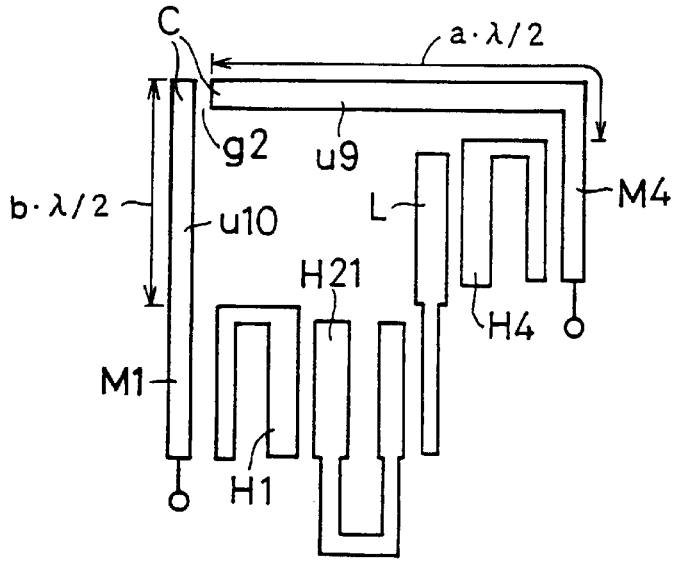
Figure 13C:
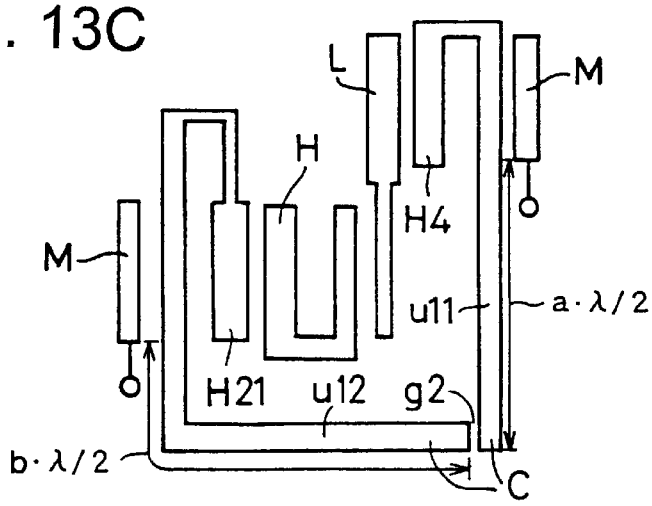

Thus, the right half circuit 62 containing the center imaginary gyrator 34 in the equivalent circuit shown in FIG. 9 is a multi-resonator band pass filter constructed with four half wavelength microstrip resonators L, H. Each example shown in FIGS. 12A to 12C and each example shown in FIGS. 13A to 13C are circuit blocks respectively corresponding to zeros on the real axis and zeros on the imaginary axis of the numerator polynomial of the circuit network function $s_{21}$ representing the transfer function. When each distributed element filter shown in FIGS. 12A to 12C and each distributed element filter shown in FIGS. 13A to 13C are connected as filter blocks in cascade by sharing therebetween the external circuit connection quarter wavelength straight microstrip lines M, the band pass filter shown in the circuit diagram of FIG. 9 can be realized.

FIGS. 13A and 13C also show examples of the distributed element filter in which the cross coupling circuit C consisting of an a/2 wavelength microstrip line u7, u9, u11 and a b/2 wavelength microstrip line u8, u10, u12 is connected to the fourth-order sequentially connected band pass filter L, H. The cross coupling circuit C is formed, in FIG. 13A, between the first and fourth half wavelength straight microstrip resonators L1, L4; in FIG. 13C, between the half wavelength hairpin microstrip line H4 and one-wavelength hairpin microstrip line H21; and in FIG. 13B, between the external circuit connection quarter wavelength straight microstrip lines M1, M4 formed together with the first and fourth microstrip resonators H1, H4.

As in the examples of FIGS. 12A to 12C, in the examples of FIGS. 13A to 13C also, a slit g2 is formed between the a/2 wavelength microstrip line u7, u9, u11 and b/2 microstrip line u8, u10, u12, and by capacitive coupling via this slit g2, the circuit becomes equivalent to a configuration in which a capacitive element is connected in series as a reactance element. In these examples, one of the first to fourth half wavelength microstrip resonators L, H is replaced by one one wavelength microstrip resonator H21, and these resonators L, H, H21 are sequentially connected with each resonator coupled with adjacent resonators over a distance of approximately one quarter wavelength; here, the one-wavelength microstrip resonator H21 replacing one of the half wavelength microstrip resonators functions as a phase inverting circuit.

As shown in the examples of FIGS. 13A to 13C, the switching of the sign of the reactance element in the cross coupling circuit C may be accomplished either within the sequentially connected resonant circuits or by changing the value of (a+b) for the microstrip lines of the cross coupling circuit C; in any way, a method easier to implement in the construction of the distributed element filter with the desired characteristics should be chosen.

Next, fourth and fifth embodiments of the distributed element filter of the invention will be described.

In the distributed element filter according to the fourth and fifth embodiments of the invention, since the circuit block corresponding to the real zeros or imaginary zeros of the numerator rational polynomial of the circuit network function is implemented by a filter block constructed from the first distributed element filter of the invention, a filter circuit that is theoretically accurate, is simple in structure, and provides improved performed by suppressing losses can be constructed and realized.

Figure 14:
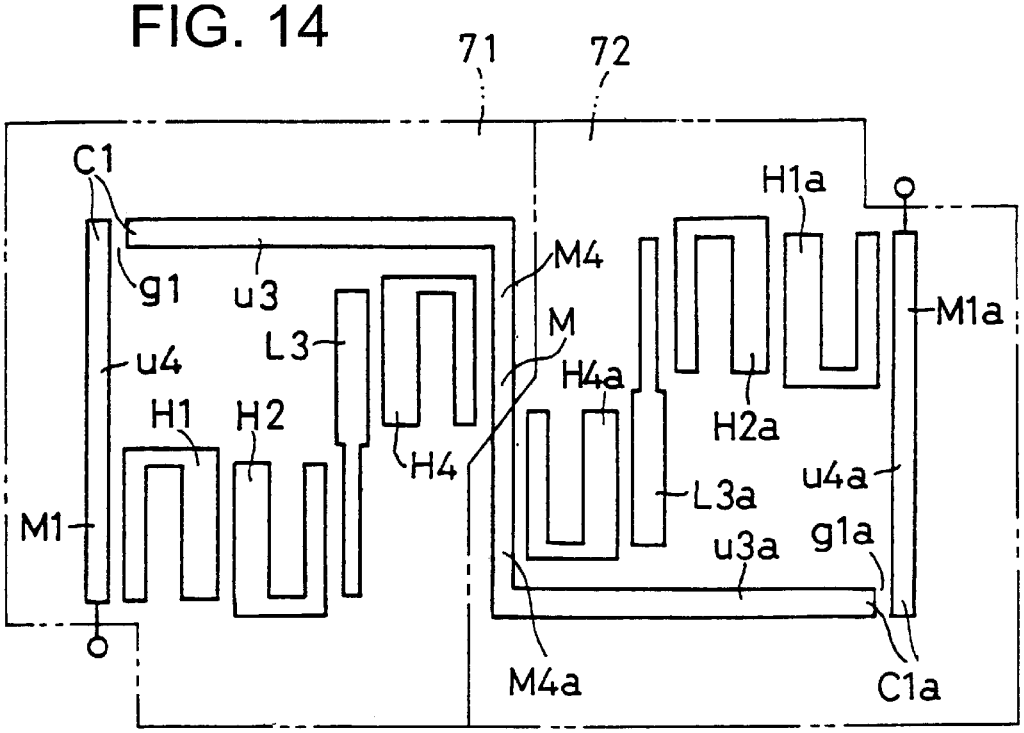
FIG. 14 is a diagram showing an eighth order band pass filter as a fourth embodiment of the distributed element filter of the invention.
Figure 15:
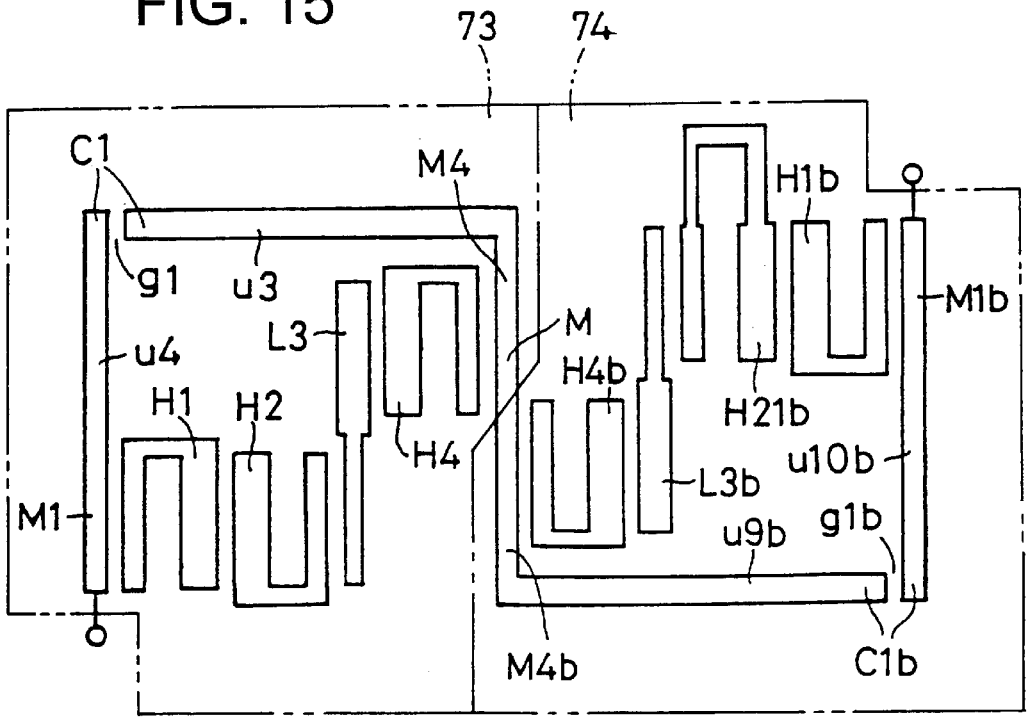
FIG. 15 is a diagram showing an eighth order band pass filter as a fifth embodiment of the distributed element filter of the invention.
Figure 16A:
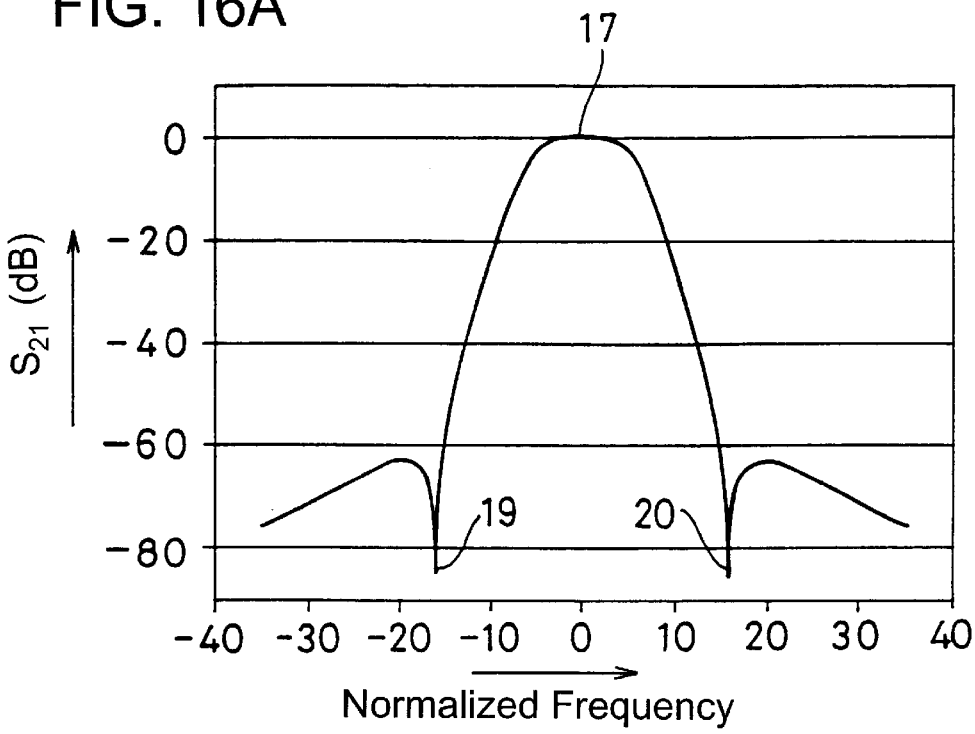
FIGS. 16A and 16B are diagrams showing an amplitude characteristic and a group delay characteristic, respectively, in the passband of a band pass filter.
Figure 16B:
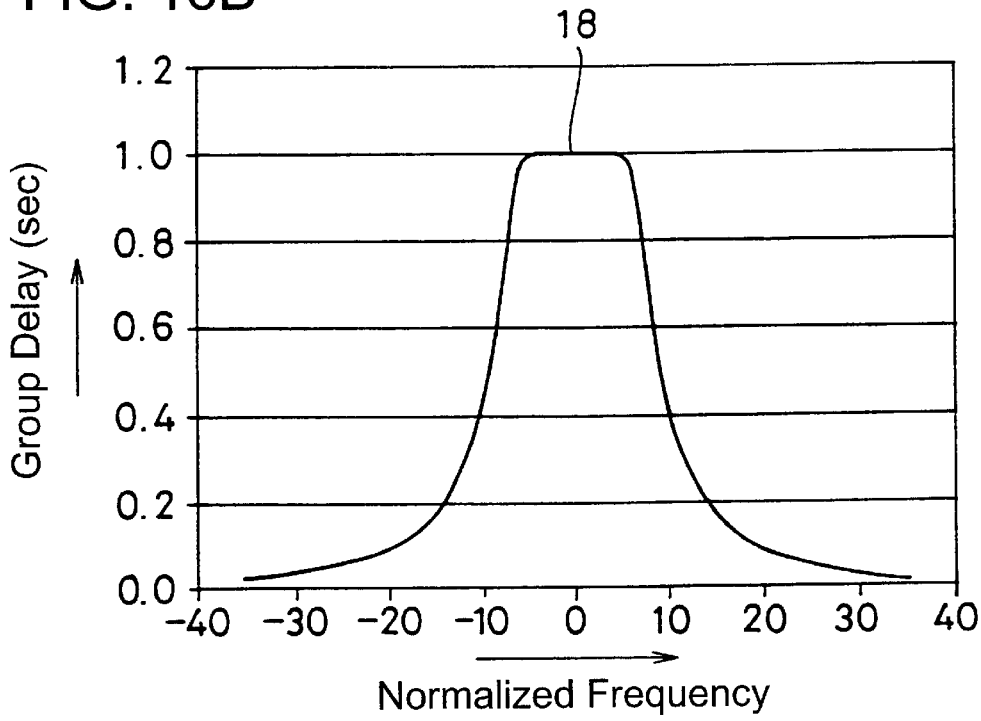
Figure 17A:
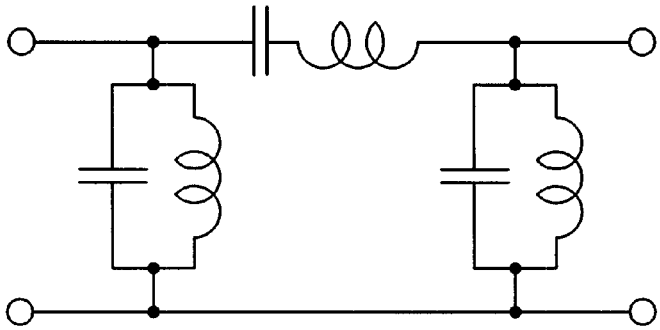
FIG. 17A PRIOR ART
FIG. 17A is a circuit diagram showing an example of a third order filter.
Figure 17B:
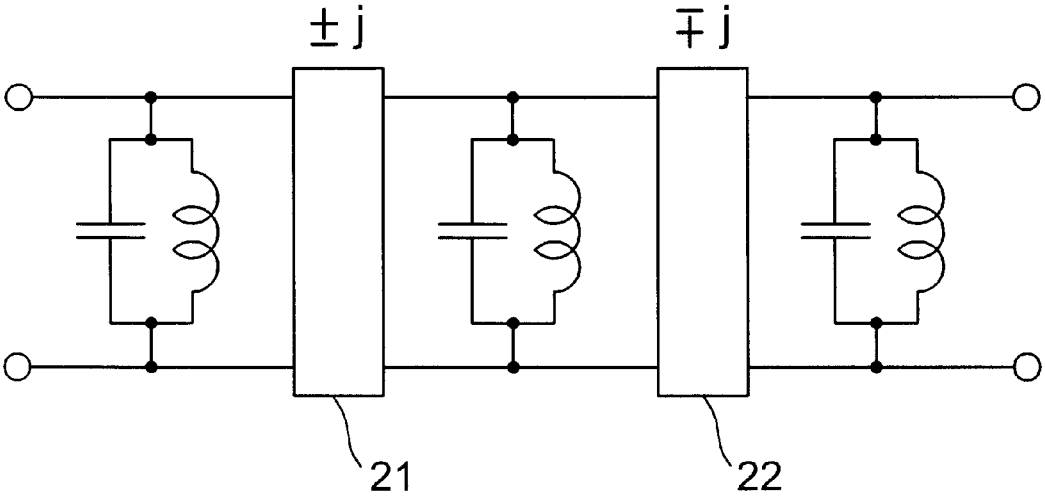
FIG. 17B PRIOR ART
FIG. 17B is a circuit diagram showing a third order filter equivalent to FIG. 17A constructed using gyrators.
Figure 18A:
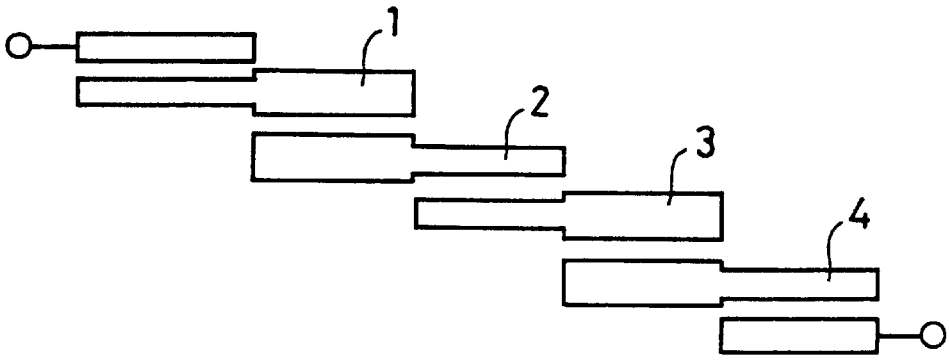
FIG. 18A PRIOR ART
FIGS. 18A and 18B are plan views showing configuration examples of a multi-resonator filter of straight line type and a multi-resonator filter of hairpin type, respectively.
Figure 18B:
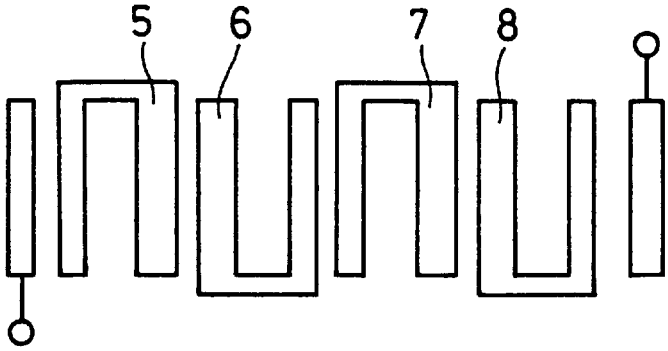
FIG. 18B PRIOR ART
Figure 19A:
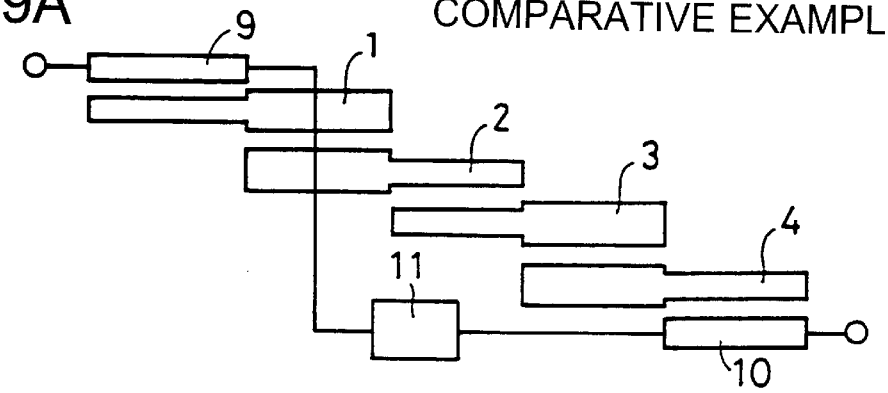
FIGS. 19A to 19D are plan views showing configuration examples of multi-resonator filters of straight line type and multi-resonator filters of hairpin type, each containing a cross coupling circuit.
Figure 19B:
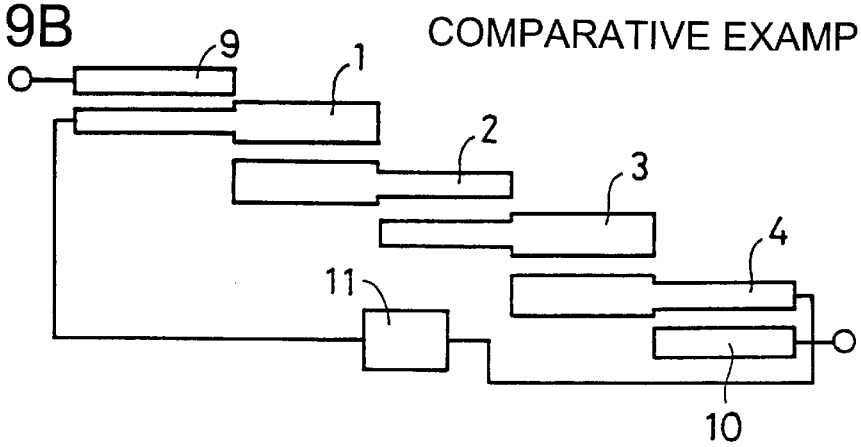
Figure 19C:
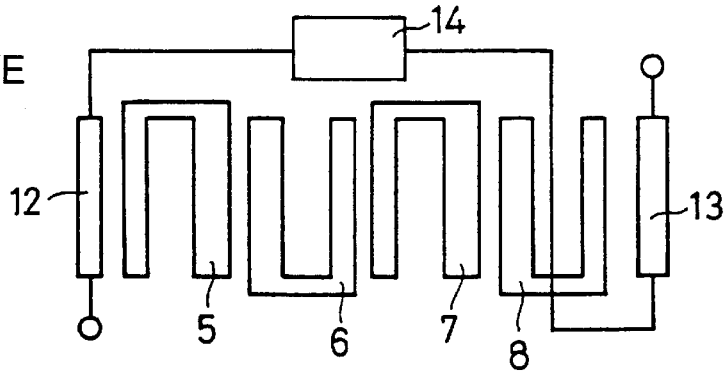
Figure 19D:
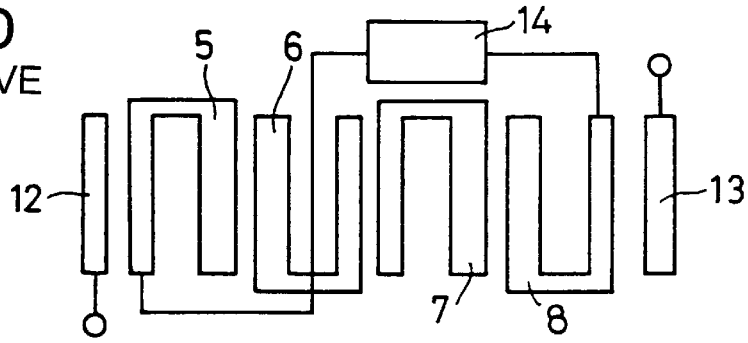

FIG. 14 is a plan view showing a distributed element filter according to an embodiment of the invention, in which the distributed element filter is constructed from a combination of two filter blocks, each identical to the distributed element filter shown in FIG. 12B, but the value of (a+b) for the microstrip lines forming the cross coupling circuit is different between the two blocks. FIG. 15 is a plan view showing a distributed element filter according to another embodiment of the invention, in which the distributed element filter is constructed by combining the distributed element filters of FIGS. 12B and 13B. The distributed element filter shown in FIG. 14 corresponds to the distributed element filter of the fourth embodiment of the invention, while the distributed element filter shown in FIG. 15 corresponds to the distributed element filter of the fifth embodiment of the invention.

In the fourth embodiment shown in FIG. 14, the distributed element filter comprises a filter block 71, in which three half wavelength microstrip resonators H1, H2, H4, each formed from a hairpin microstrip line, and one half wavelength microstrip resonator L3 formed from a straight microstrip line are sequentially connected and a cross coupling circuit C1 is connected to external circuit connection quarter wavelength microstrip lines M1, M4, and a similar filter block 72, in which three half wavelength microstrip resonators H1*a*, H2*a*, H4*a*, each formed from a hairpin microstrip line, and one half wavelength microstrip resonator L3*a* formed from a straight microstrip line are sequentially connected and a cross coupling circuit C1*a* is connected to external circuit connection quarter wavelength microstrip lines M1*a*, M4*a*, and the two filter blocks are connected in cascade by sharing the interposed quarter wavelength straight microstrip lines M (that is, M4 and M4*a*) between them.

In the example of FIG. 14, the values of (a+b) for the cross coupling circuits C1, C1*a* in the respective filter blocks 71, 72 are set different from each other so that the difference between the values becomes an odd number.

In the fifth embodiment shown in FIG. 15, the distributed element filter comprises a filter block 73, in which three half wavelength microstrip resonators H1, H2, H4, each formed from a hairpin microstrip line, and one half wavelength microstrip resonator L3 formed from a straight microstrip line are sequentially connected and a cross coupling circuit C1 is connected to external circuit connection quarter wavelength microstrip lines M1, M4, and a filter block 74, in which two half wavelength microstrip resonators H1*b*, H2*b*, each formed from a hairpin microstrip line, one one wavelength microstrip resonator H21*b* also formed from a hairpin microstrip line, and one half wavelength microstrip resonator L3*b* formed from a straight microstrip line are sequentially connected and a cross coupling circuit C1*b* is connected to external circuit connection quarter wavelength microstrip lines M1*b*, M4*b*, and the two filter blocks are connected in cascade by sharing the interposed quarter wavelength straight microstrip lines M (that is, M4 and M4*b*) between them.

In the example of FIG. 15, the values of (a+b) for the cross coupling circuits C1, C1*b* in the respective filter blocks 73, 74 may be made equal to each other or may be set different from each other so that the difference between the values becomes an even number.

According to the embodiment shown in FIG. 15, since replacing at least one of the half wavelength microstrip resonators (H1, H2, L3, H4; H1*b*, H21*b*, L3*b*, L4*b*) in the filter blocks 73, 74 by a one-wavelength microstrip resonator achieves the effect of reversing the phase of the transmission characteristics of the sequentially coupled multi-resonator filters 73, 74 in a controlled manner, cross coupling circuits designed exactly as intended can be added. When replacing at least one of the half wavelength microstrip resonators by a one-wavelength microstrip resonator, since the one-wavelength microstrip resonator is equivalent in function to a half wavelength microstrip resonator with a half wavelength phase shifter added to it, the number of replacing resonators should preferably be made odd.

As can be seen from the above realizations of the distributed element filter of the invention, the cross coupling circuit C can be connected to the intended ports without crossing any of the resonators, and thus the band pass filter can be realized while retaining its planar circuit structure.

In the examples shown in FIGS. 14 and 15, the cross coupling circuit C1, C1*a*; C1*b* is connected to the quarter wavelength straight microstrip lines M1, M4; M1*a*, M4*a*; M1*b*, M4*b*, respectively, but in an alternative embodiment, the cross coupling circuit C may be connected to the ends of the half wavelength microstrip resonators L, H, or an equivalent one-wavelength microstrip resonator, coupled to the quarter wavelength straight microstrip lines M.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A distributed element filter comprising:

a number, n, of half wavelength of a passband center frequency microstrip resonators consisting of straight and hairpin microstrip lines, wherein n is an even number equal to or more than 4, wherein the n half wavelength microstrip resonators are connected sequentially with each resonator coupled with adjacent resonators over a length of approximately one quarter wavelength, and wherein respective numbers of straight microstrip lines and hairpin microstrip lines of the n half wavelength microstrip resonators being both odd;

at least two external circuit connection quarter wavelength straight microstrip lines, one which is coupled to a first half wavelength microstrip resonator and a second of which is coupled to an n-th half wavelength microstrip resonator; and a cross coupling circuit connected to one of the ends of the first and the n-th half microstrip resonators, the ends being of a side on which the first and the n-th half microstrip resonators are coupled with the external circuit connection quarter wavelength straight microstrip lines and the ends of the external circuit connection quarter wavelength straight microstrip lines.

2. A distributed element filter comprising:

a number, n, of microstrip resonators including half wavelength of a passband center frequency microstrip resonators and at least one one wavelength of a passband center frequency microstrip resonator and consisting of straight and hairpin microstrip lines, wherein n is an even number equal to or more than 4, wherein the n microstrip resonators are connected sequentially with each resonator coupled with adjacent resonators over a length of approximately one quarter wavelength, and wherein respective numbers of straight microstrip lines and hairpin microstrip lines of the n half wavelength microstrip resonators being both odd;

at least two external circuit connection quarter wavelength straight microstrip lines, one which is coupled to a first half wavelength microstrip resonator and a second of which is coupled to an n-th half wavelength microstrip resonator; and a cross coupling circuit connected to ends of the first and the n-th microstrip resonators, the ends being of a side on which the first and the n-th microstrip resonators are coupled with one of the external circuit connection quarter wavelength straight microstrip lines and the ends of the external circuit connection quarter wavelength straight microstrip lines.

3. The distributed element filter of claim 1, wherein the distributed element filter has band pass characteristics in which both of amplitude characteristics and group delay characteristics of the passband are flat and a transmission zero is in a stopband thereof.

4. The distributed element filter of claim 2, wherein the distributed element filter has bandpass characteristics in which both of amplitude characteristics and group delay characteristics of the passband are flat and a transmission zero is in a stopband thereof.

5. A distributed element filter comprising:

a number, n, of half wavelength of a passband center frequency microstrip resonators consisting of straight and hairpin microstrip lines, wherein the number, n, is an even number equal to or more than 4, wherein then half wavelength microstrip resonators are connected sequentially with each resonator coupled with adjacent resonators over a length of approximately one quarter wavelength, wherein respective numbers of straight microstrip lines and hairpin microstrip lines of the n half wavelength microstrip resonators are both odd;

at least two external circuit connection quarter wavelength straight microstrip lines, one of which is coupled to a first half wavelength micrsotrip resonator and, and a second of which is couple to an n-th half wavelength microstrip resonator; and a cross coupling circuit consisting of an a/2 wavelength microstrip line, wherein a is a natural number, and a b/2 wavelength microstrip line, wherein b is a second natural number, capacitively coupled via a slit, the cross coupling circuit being connected to one of an end of each of the first and the n-th half microstrip resonators, the ends being of a side on which the first and the n-th half microstrip resonators are coupled with the external circuit connection quarter wavelength straight microstrip lines and the ends of the external circuit connection quarter wavelength straight microstrip lines.

6. The distributed element filter of claim 5, wherein the external circuit connection quarter wavelength straight microstrip lines are connected in cascade, and at least one of the values of numbers a and b for the microstrip lines in the cross coupling circuit of the plurality of distributed element filters is odd and at least one thereof is even.

7. A distributed element filter comprising:

a number, n, of microstrip resonators including half wavelength of a passband center frequency microstrip resonators and at least one one wavelength of a passband center frequency microstrip resonator and consisting of straight and hairpin microstrip lines, wherein the number, n, is an even number equal to or more than 4, wherein the n half wavelength microstrip resonators are connected sequentially with each resonator coupled with adjacent resonators over a length of approximately one quarter wavelength, wherein respective numbers of straight microstrip lines and hairpin microstrip lines of the n half wavelength microstrip resonators are both odd;

at least two external circuit connection quarter wavelength straight microstrip lines, one of which is coupled to a first micrsotrip resonator and, and a second of which is couple to an n-th microstrip resonator; and a cross coupling circuit consisting of an a/2 wavelength microstrip line, wherein a is a natural number, and a b/2 wavelength microstrip line, wherein b is a natural number, capacitively coupled via a slit, the cross coupling circuit being connected to one of an end of each of the first and the n-th microstrip resonators, the ends being of a side on which the first and the n-th microstrip resonators are coupled with the external circuit connection quarter wavelength straight microstrip lines and the external circuit connection quarter wavelength straight microstrip lines, wherein the external circuit connection quarter wavelength straight microstrip lines are connected in cascade.

8. The distributed element filter of claim 5, wherein the distributed element filter has bandpass characteristics in which both of amplitude characteristics and group delay characteristics of the passband are flat and transmission zeros are formed in a stopband thereof.

9. The distributed element filter of claim 6, wherein the distributed element filter has bandpass characteristics in which both of amplitude characteristics and group delay characteristics of the passband are flat and transmission zeros are formed in a stopband thereof.

10. The distributed element filter of claim 7, wherein the distributed element filter has bandpass characteristics in which both of amplitude characteristics and group delay characteristics of the passband are flat and transmission zeros are formed in a stopband thereof.

* * * * *